US005377430A

United States Patent [19]

Hatfield et al.

[11] Patent Number: 5,377,430

[45] Date of Patent: Jan. 3, 1995

[54] SHOE WITH ELASTIC CLOSURE SYSTEM

[75] Inventors: Tinker L. Hatfield; William M. Dieter, both of Portland, Oreg.

[73] Assignee: Nike, Inc., Beaverton, Oreg.

[21] Appl. No.: 122,335

[22] Filed: Sep. 17, 1993

[51] Int. Cl.[6] ..... A43B 11/00

[52] U.S. Cl. ..... 36/51; 36/50.1; 24/714.6

[58] Field of Search ..... 36/50.1, 51, 114; 24/713.3, 713.6, 714.6, 714.7, 714.8, 715.3

[56] References Cited

U.S. PATENT DOCUMENTS

| | | | |
|---|---|---|---|
| Re. 26,340 | 2/1968 | Dassler . | |
| D. 278,186 | 4/1985 | Michaeli . | |
| D. 294,422 | 3/1988 | Gamm . | |
| D. 296,606 | 7/1988 | Sorofman . | |
| D. 303,452 | 9/1989 | Swett . | |
| D. 315,979 | 4/1991 | Legacki et al. . | |
| D. 330,626 | 11/1992 | McDonald et al. . | |
| D. 331,486 | 12/1992 | Dahlsten et al. . | |
| 544,263 | 8/1895 | Norton | 36/51 |
| 640,755 | 1/1900 | Donavan | 24/714.7 |
| 697,590 | 4/1902 | Wright | 24/715.3 |
| 913,012 | 2/1909 | Jackson | 36/51 |
| 2,147,197 | 2/1939 | Glidden . | |
| 2,311,996 | 2/1943 | Parker | 36/51 |
| 2,679,117 | 5/1954 | Reed . | |
| 3,040,454 | 6/1962 | Topper et al. | 36/51 |
| 3,138,880 | 6/1964 | Kunzli . | |
| 3,613,273 | 10/1971 | Marquis . | |
| 3,822,488 | 7/1974 | Johnson . | |
| 4,255,876 | 3/1981 | Johnson . | |
| 4,438,574 | 3/1984 | Johnson . | |
| 4,447,967 | 5/1984 | Zaino . | |
| 4,486,965 | 12/1984 | Friton . | |
| 4,553,342 | 11/1985 | Derderian et al. . | |
| 4,592,154 | 6/1986 | Oatman | 36/50.1 |
| 4,616,432 | 10/1986 | Bunch et al. . | |
| 4,670,998 | 6/1987 | Pasternak . | |
| 4,736,531 | 4/1988 | Richard . | |
| 4,769,927 | 9/1988 | Liggett et al. | 36/50.1 |
| 4,817,303 | 4/1989 | Selbiger . | |
| 4,858,339 | 8/1989 | Hayafuchi et al. . | |
| 4,901,452 | 2/1990 | Wang | 24/713.6 |
| 4,922,630 | 5/1990 | Robinson . | |
| 4,942,678 | 7/1990 | Gumbert . | |
| 5,042,120 | 8/1991 | Nichols . | |
| 5,184,378 | 2/1993 | Batra . | |

FOREIGN PATENT DOCUMENTS

| | | | |
|---|---|---|---|
| 6801 | 1/1902 | Austria | 36/51 |
| 2658997 | 9/1991 | France | 36/51 |
| 1017946 | 10/1957 | Germany . | |
| 3415960 | 11/1984 | Germany | 36/51 |
| 4018518A1 | 1/1991 | Germany . | |
| 339919 | 12/1930 | United Kingdom | 36/51 |

OTHER PUBLICATIONS

K-Swiss's price list, unnumbered page, prices effective as of Dec. 1992.

K-Swiss's Coop Advertising Add Planner, p. 27, Copyright date 1994.

*Primary Examiner*—Steven N. Meyers

*Attorney, Agent, or Firm*—Banner, Birch, McKie & Beckett

[57] ABSTRACT

The present invention is directed to a shoe having an upper and a sole including an elastic closure and fit system for securing and fitting a shoe to a foot. Elastic material is secured along the base of the upper on the medial and lateral sides of the shoe. A plurality of straps are separately and independently attached at their lower end to the elastic material. The straps are made of a substantially inelastic material. Lace openings are positioned at the upper ends of the straps and a lace is disposed in the openings. As the lace is drawn, the straps are tightened about the foot to place under tension the elastic material disposed along the medial and lateral sides of the foot.

32 Claims, 10 Drawing Sheets

SHOE WITH ELASTIC CLOSURE SYSTEM

BACKGROUND OF THE INVENTION

1. Field of the Invention

The present invention is directed to a shoe with an improved closure and fit system, and in particular, a system including straps that are independently attached to an elastic material secured about the sides of the shoe.

2. Description of the Prior Art

Numerous closure means are known in the prior art for securing or fitting a shoe to a foot. The most common and relatively simple technique is the use of a lacing system. In a simple form of a lacing system, the upper is split down its middle bisecting the area above the instep, and eyelets are located along either side of the split. A lace is passed through the eyelets and crisscrossed across the split from the bottom of the split to the top of the split. By pulling on the upper free ends of the lace, the split portions of the upper are drawn toward one another and the shoe is tightened to the foot.

There are many variations to this basic form of lacing system. For example, the eyelets can be located at various widths across the split in the upper such as shown in U.S. Pat. No. 4,255,876, or the use of speed laces in combination with a variable width lacing such as disclosed in U.S. Pat. No. 4,553,342, both recited patents are hereby incorporated by reference herein.

The use of straps in shoe lacing systems is also known in the an. Straps have been used in shoes as a replacement for conventional laces, or as an adjunct to a lacing system. U.S. Pat. No. 4,486,965 is an example of the use of straps as a replacement for conventional laces, and is hereby incorporated by reference herein. In this patent, straps are formed as an integral extension of the upper material and include hook and pile fasteners on the outer surface of the upper.

Shoes including the use of straps as part of lacing systems are also known in the art. U.S. Pat. No. 2,147,197 discloses a shoe having an elastic upper which uses straps in conjunction with laces as the shoe tightening system. In a first embodiment, the shoe has a blucher saddle disposed in the arch area with lace eyelets on its upper end. The blucher saddle is attached at its lower end to the elastic upper. The blucher saddle is disclosed in the specification as being made of rubber as its preferred material. Moreover, it is stated that some or all of the parts applied to the upper in the first embodiment described and in the other embodiments may in some cases be made of any other suitable material, such as fabric or leather. It is further disclosed that the rubber used may be unenforced or reinforced by, for instance, fabric. In another embodiment, straps extend upward from the sole over an elastic upper and have eyelets on their upper ends. Additionally, there is a heel strap attached to the heel counter which also has eyelets on its forward ends. The straps are disclosed as being made of rubber.

Straps can also be used in conjunction with laces to augment the primary lace tightening system. The use of laces in such shoes can be for the purpose of providing additional ankle support. Examples of such strap uses include U.S. Pat. No. 4,922,630, hereby incorporated by reference herein, and U.S. Pat. No. 3,613,273.

The closure systems discussed above do not offer a suitable amount of customizing when securing a shoe to a foot to take into account the different anatomical features of an individual wearer.

SUMMARY OF THE INVENTION

The present invention is directed to a shoe having an upper and a sole and including an elastic closure system for securing a shoe to a foot. Elastic material is secured along the base of the upper on the medial and lateral sides of the shoe. A plurality of straps are independently attached adjacent their lower ends to the elastic material. The straps are made of a relatively in-elastic material. Closure means are disposed on the upper ends of the straps. The closure means draw the straps about the foot to place under tension the elastic material disposed along the medial and lateral sides of the shoe.

An object of this present invention is the creation of an elastic closure and fit system that secures a shoe to a wearer's foot while providing enhanced conformance and fit.

DETAILED DESCRIPTION OF THE PREFERRED EMBODIMENTS

Figure 1:
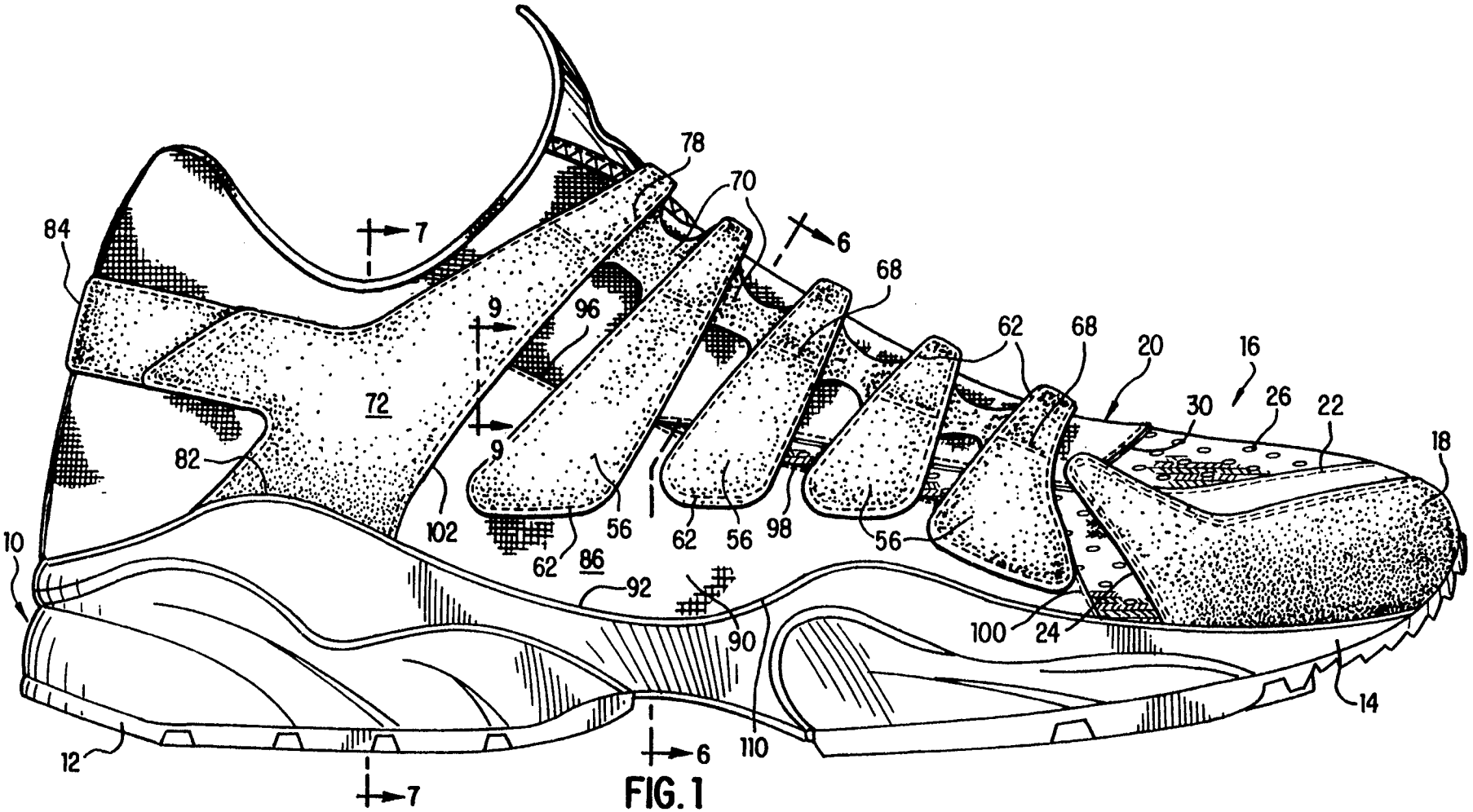
FIG. 1 shows a side elevational view of the lateral side of a right shoe having a closure and fit system according to the present invention.
Figure 2:
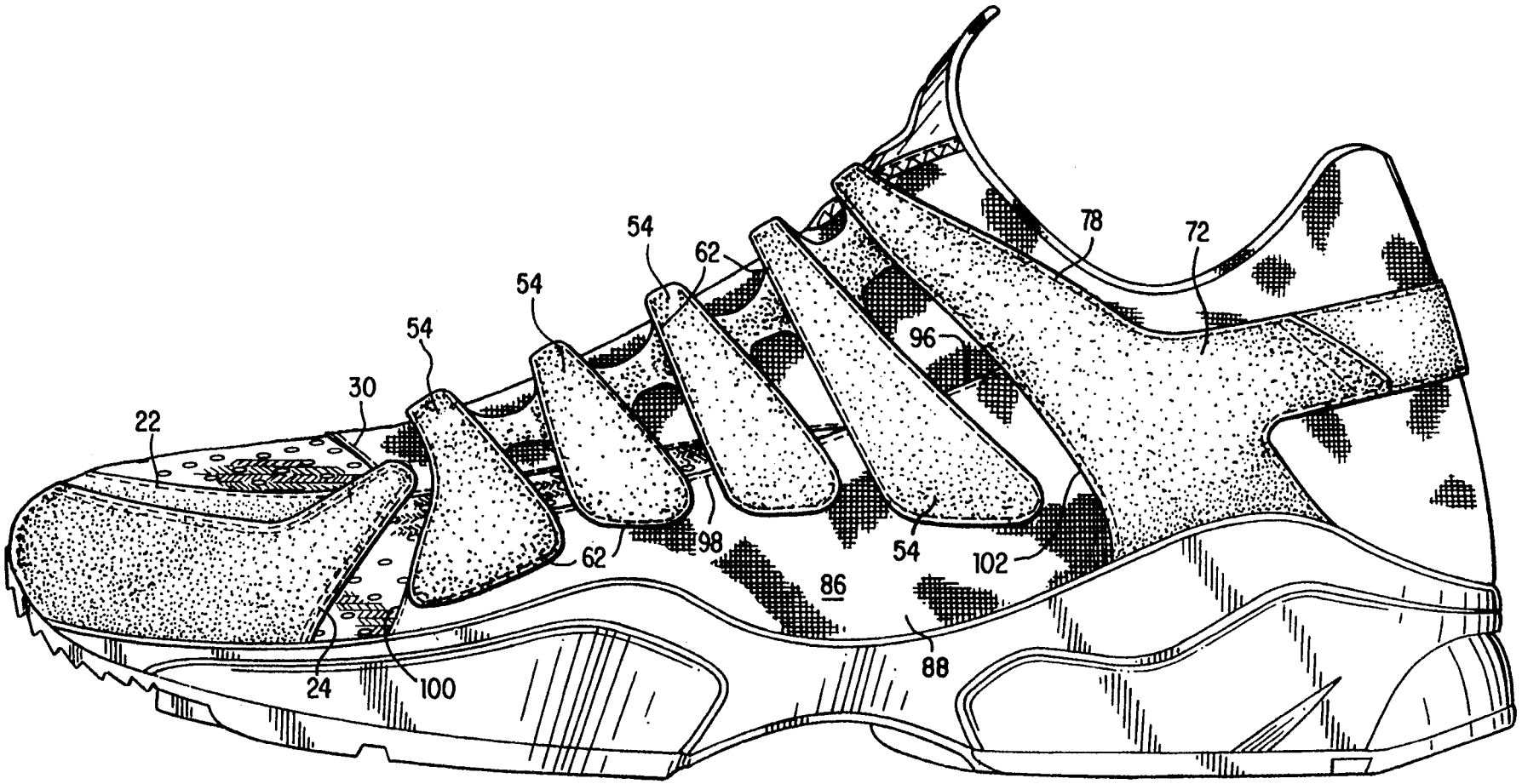
FIG. 2 shows a side elevational view of the medial side of the shoe depicted in FIG. 1.
Figure 3:
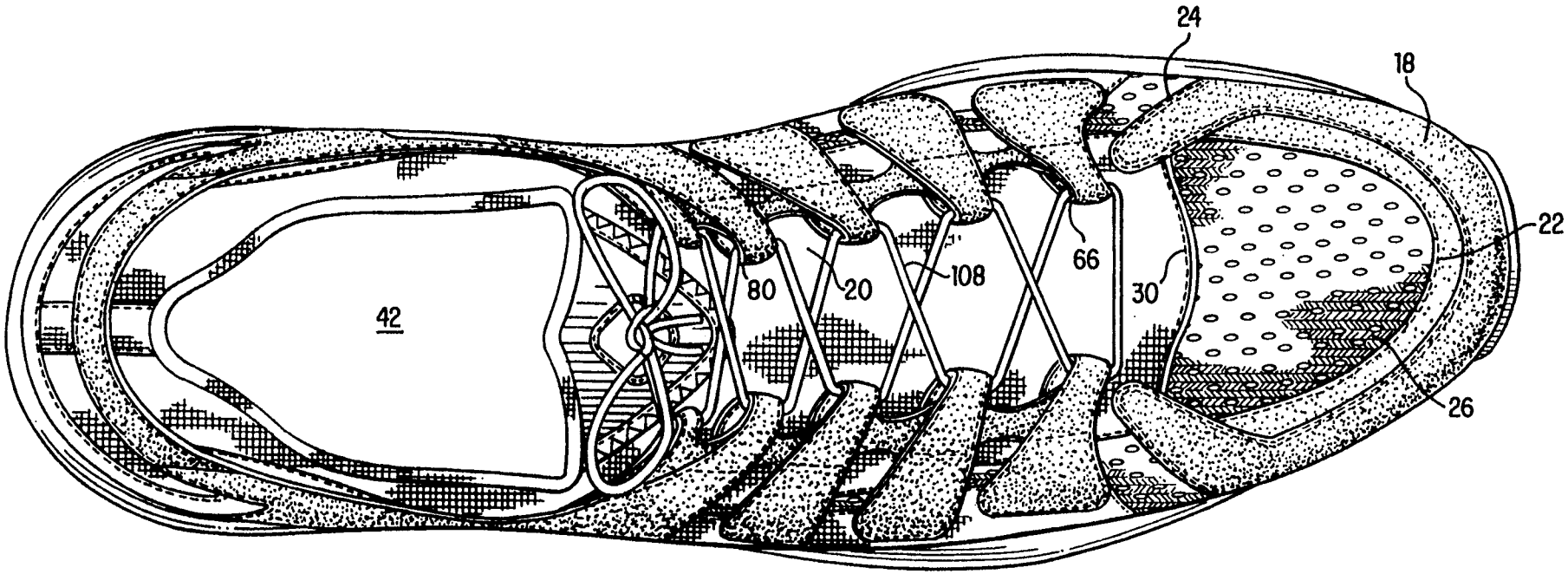
FIG. 3 shows a top plan view of the shoe depicted in FIG. 1.
Figure 4:
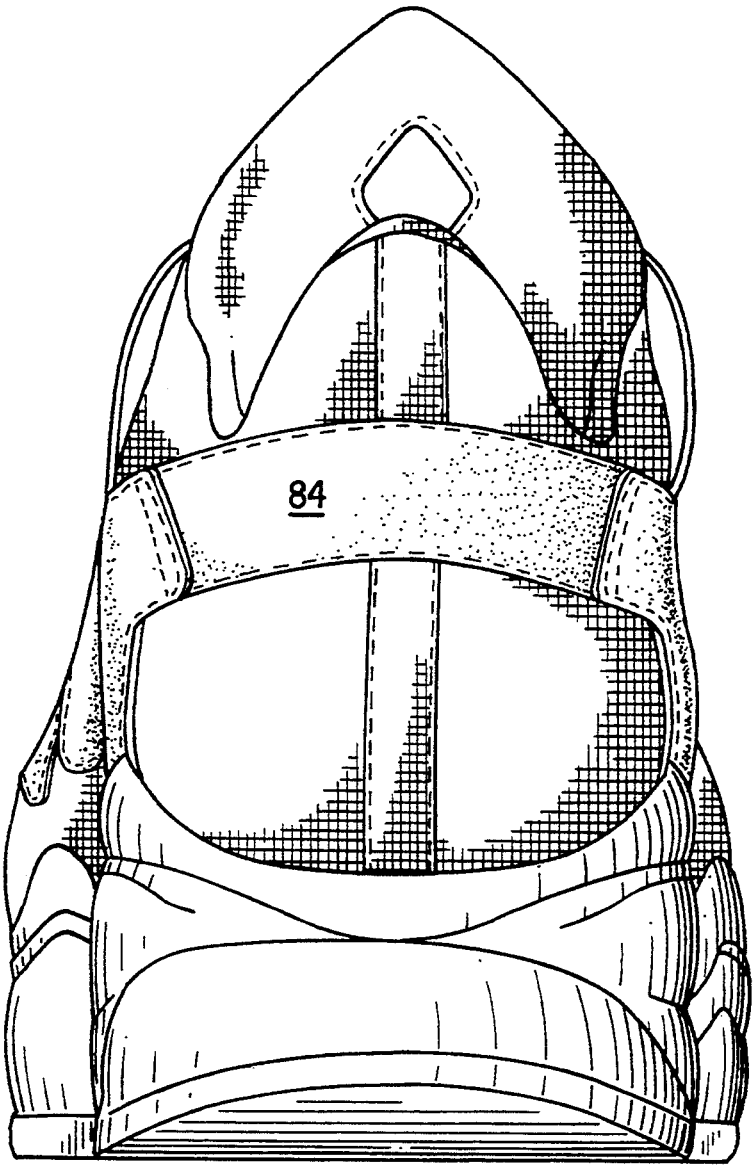
FIG. 4 shows a rear elevational view of the shoe depicted in FIG. 1.

With reference to FIGS. 1–4, a shoe having a closure and fit system according to the present invention is shown. The shoe includes a conventional sole 10, which may further include conventional outsole 12 and conventional midsole 14. Upper 16 is secured to the upper surface of sole 10 and includes a toe reinforcement section or tip 18 and an inner sleeve 20. Section 18 can be made of a conventional material such as natural or synthetic leather. Inner sleeve 20 is attached to vamp 26 along stitch line 30. Vamp 26 is attached to section or tip 18 along stitch line 22 and stitch line 24. Vamp 26 is disposed along the top of the toes of the foot and can extend along the medial and lateral sides of the foot. Vamp 26 can be made of a stretchable or non-stretchable breathable material, for example LYCRA ®, spandex, polyester or nylon woven and/or knit textiles. Inner sleeve 20 is generally disposed about the heel of the toot and above the instep of the foot. As shown in FIGS. 6 and 7, inner sleeve 20 has outer layer 38 made of a stretchable material, for example neoprene, and inner layer 40 made of a stretchable material, for example spandex or LYCRA ®. As shown in FIG. 3, outer layer 38 and inner layer 40 are stitched together at their top ends around foot opening 42. As shown in FIG. 7, in the heel portion of the shoe, cushioning material 44 is disposed in between outer layer 38 and inner layer 40.

Insole board 46 is disposed inside upper 16 and along the top of sole 10, and can be made of a relatively stiff, sturdy material, for example non-woven fiber board, cardboard, or TEXON ®. With reference to FIGS. 1, 2, 6 and 7, insole board 46 is attached to an upper surface of midsole 14 in a conventional manner, such as with an adhesive, and to vamp 26 and inner sleeve 20 by stitching 48. Stitching 48 extends from the lower end of stitch line 24 on the lateral side of the shoe along the perimeter of the top of sole 10, and to the lower end of stitch line 24 on the medial side. In FIGS. 6 and 7, insole board 46 is respectively positioned on top of vamp 26 and inner sleeve 20 along stitching 48. Further, with reference to FIG. 6, vamp 26 is attached to insole board 46 in the middle portion of the shoe, and, with reference to FIG. 7, inner sleeve 20 is attached to insole board 46 in the rear and heel regions of the shoe. A soft sock liner 50 is disposed along the full length of the shoe on top of insole board 46 for comfort.

Figure 6A:
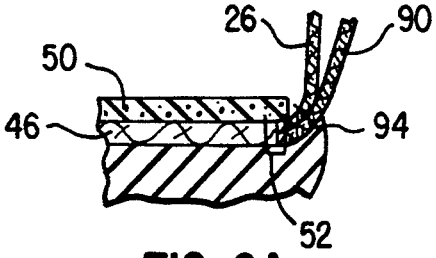
FIG. 6A shows a sectional view similar to the sectional view in FIG. 6 but depicting an alternative stitching arrangement.
Figure 6:
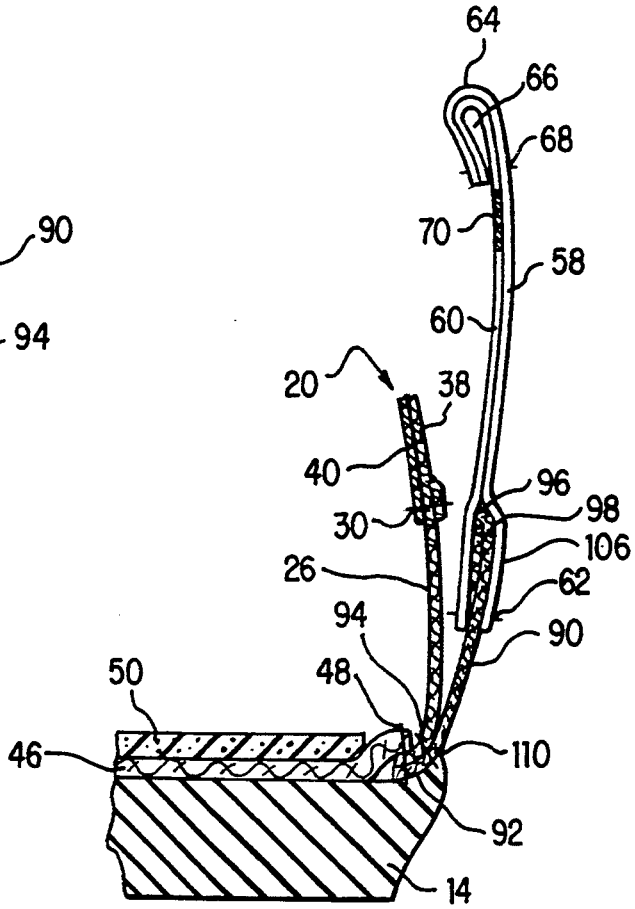
FIG. 6 shows a sectional view taken along line 6—6 of FIG. 1.
Figure 7A:
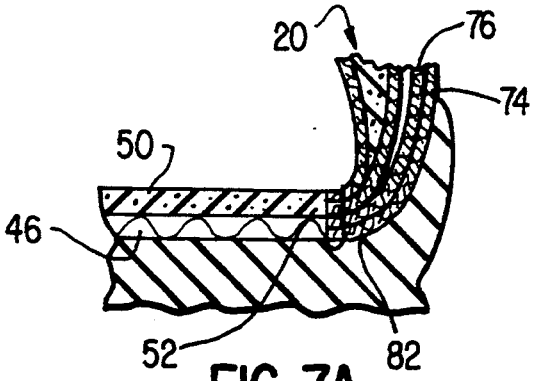
FIG. 7A shows a sectional view similar to FIG. 7 but depicting an alternative stitching arrangement.
Figure 7:
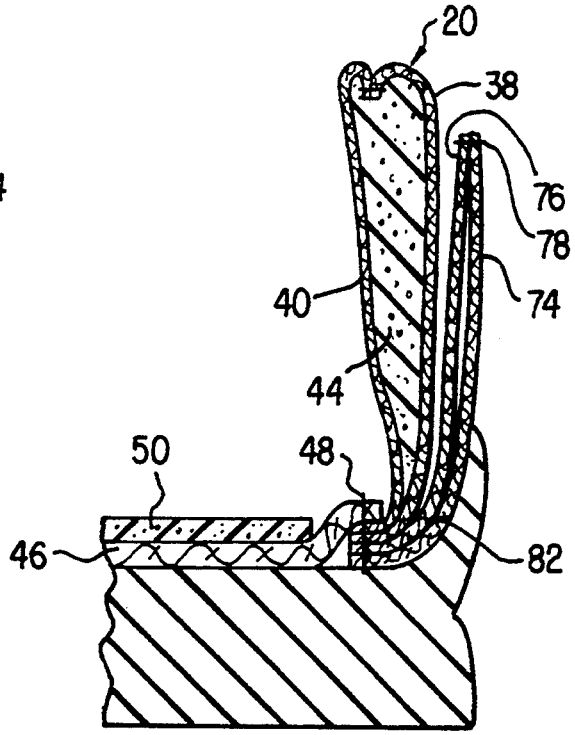
FIG. 7 shows a sectional view taken along line 7—7 of FIG. 1.

With reference to FIGS. 6A and 7A, an alternative stitching arrangement is shown. FIGS. 6A and 7A are partial sectional views similar to FIGS. 6 and 7 and show an alternative stitching arrangement. In FIGS. 6A and 7A, insole board 46 is shown in a generally flush relationship with vamp 26 and inner sleeve 20, respectively. Stitching 52 is used to join insole board 46 to inner sleeve 20 and vamp 26 and would extend along the same path as stitching 48. Stitching 52 can be of a zigzag, loop, or Stroebel type which allows the joining of insole board 46 with vamp 26 and inner sleeve 20 in the generally flush relationship.

Figure 8:
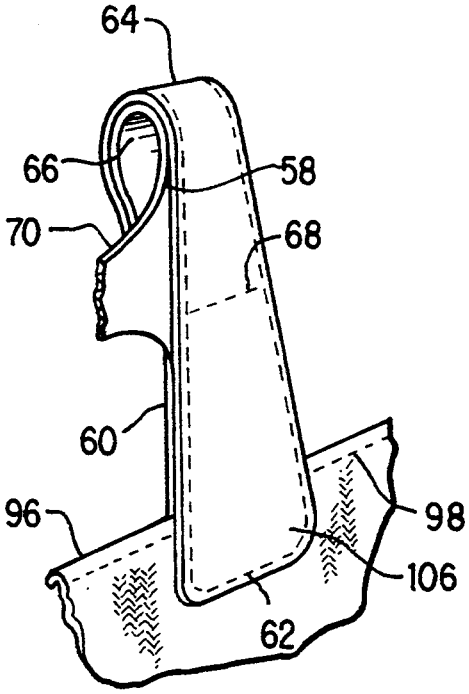
FIG. 8 shows a partial perspective view of one of the straps depicted in FIG. 1.

As shown in FIGS. 1 and 2, straps 54 are located on the medial side of the shoe and straps 56 are located on the lateral side of the shoe. In FIGS. 6 and 8, one of straps 54 and 56 is depicted. Each of straps 54 and 56 are identical in construction to the strap depicted in FIGS. 6 and 8 although their general shape may vary. Each strap 54 and 56 can have a two-layer construction comprised of outer layer 58 and inner layer 60. Each strap has stitching 62 which holds outer layer 58 and inner layer 60 together. Upper end 64 of each strap can be folded over to form lace loop or eyelet 66. Loop 66 is held in position by stitching 68. Alternatively, an eyelet can be formed by an opening or an insert, for example, by a plastic material affixed to the upper end 64 of each strap 54 and 56. Straps 54 and 56 are depicted as connected together by web portions 70. However, the straps can be completely independent of one another. Web portions 70 are continuous parts of inner layer 60 of each of the straps. Web portions 70 serve to hold straps 54 and 56 in a spatial relationship but do not substantially inhibit straps 54 and 56 from acting in relative independence in conforming to the foot when used with the closure system of the present invention. Straps 54 and 56 are made of a substantially in-elastic material, for example natural or synthetic leather.

As shown in FIGS. 1, 2 and 7, medial and lateral rearward straps 72 are positioned in the heel area of the shoe and can also be made of a two-layer construction comprised of an outer layer 74 and inner layer 76. Outer layer 74 and inner layer 76 are held together by stitching 78. The tops of rearward straps 72 are folded over to form lace loops or eyelets 80 as previously described with reference to straps 54 and 56. Openings or plastic inserts can also be positioned on the upper end of straps 72 to form eyelets. As shown in FIG. 7 for the lateral rearward strap 72, the medial rearward strap being of identical construction, lower end 82 of rearward strap 72 is attached to inner sleeve 20 and insole board 46 by stitching 48. In this stitching arrangement, lower end 82 of rearward strap 72 is positioned below or outside of inner sleeve 20. In the alternative stitching arrangement in FIG. 7A, lower end 82 of rearward strap 72 is positioned below or outside of inner sleeve 20 and in a generally flush relationship with insole board 46. Stitching 52, such as a zigzag, loop, or Stroebel variety, can be used to connect insole board 46 inner sleeve 20, and lower end 82 of rearward strap 72.

Heel strap 84 is connected to the rearward ends of both rearward straps 72 by stitching and extends around the heel of the foot. As shown in FIGS. 7 and 7A, rearward straps 72 are attached to inner sleeve 20 at stitching 48 or stitching 52. Thus, rearward straps 72 are free to move in all directions with respect to inner sleeve 20 above the stitching lines. Additionally, heel strap 84 is generally not attached to inner sleeve 20, and thus, is free to move in all directions with respect to and independently from inner sleeve 20.

As shown in FIGS. 1 and 2, elastic material 86 is disposed on the medial and lateral sides of the shoe with first portion 88 disposed on the medial side and second portion 90 disposed on the lateral side. The elastic material is of a low stretch heavy duty type, for example LYCRA ®, spandex, polyester or nylon woven and/or knit textiles. Generally, the elastic material has a preferred range of elongation of greater than or equal to 50%. With reference to FIG. 6, the second or lateral portion 90 of elastic material 86 is attached at its lower end 92 to vamp 26 by stitching 94. Stitching 94 extends along the entire length of lower end 92 proximate the lasting margin 110, which is the line formed where the upper meets the sole. A stitching line identical to stitching 94 is used to attach first or medial portion 88 of elastic material 86 to vamp 26 along the medial side of the shoe. In addition to stitching 94 being used to attach first and second portions 88 and 90 to inner sleeve 20, first and second portions 88 and 90 are also attached to vamp 26 insole board 46 along stitching 48 as is shown in FIG. 6. In FIG. 6, the second or lateral portion 90 of elastic material 86 is shown as positioned below or on the outside of vamp 26 in the stitching arrangement of stitching 48. In FIG. 6, stitching 94 is shown as being slightly above stitching 48. However, stitching 94 can be co-extensive with stitching 48 along all or part of the length of stitching 94.

In the alternative stitching arrangement shown in FIG. 6A, the second or lateral portion 90 is shown below vamp 26 and generally flush with the bottom of insole board 46. In this alternative stitching arrangement, stitching 94 can also be co-extensive with stitching 52 along part or all of the length of stitching 94. Stitching 52 can be of a zigzag, loop, or Stroebel variety for holding insole board 46 in the generally flush relationship with vamp 26 and second or lateral portion 90. The stitching arrangements shown in FIGS. 6 and 6A for second or lateral portion 90 of elastic material 86 are identical to the stitching arrangement for first or medial portion 88 of elastic material 86. Thus, the stitching arrangement for first or medial portion 88 is not shown.

As shown in FIGS. 1, 2, 6, and 8, upper ends 96 of medial/first and lateral/second portions 88 and 90 of elastic material 86 are folded over upon themselves and stitched together by stitch line 98 to form a turned edge. Upper ends or edges 96 are angled downward from rearward straps 72 to a forward end 100 of each medial and lateral portion 88 and 90. The downward angle of the material provides for more elastic material to be disposed towards the rear of the instep of a foot in order to better accommodate anatomical differences between individual wearers. Forward ends 100 of medial and lateral portions 88 and 90 meet the midsole such that the upper ends or edges 96 contact the top of midsole 14.

Figure 9:
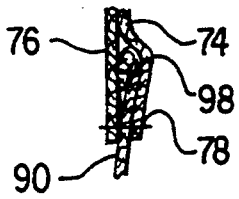
FIG. 9 shows a sectional view taken along line 9—9 of FIG. 1.

As shown in FIGS. 1 and 2, rearward ends 102 of medial and lateral portions 88 and 90 of elastic material 86 end at substantially the forward edge of rearward straps 72. With reference to FIG. 9, a small portion of rearward end 102 of second or lateral portion 90 is shown as sandwiched in between rearward strap outer layer 74 and rearward strap inner layer 76. Rearward end 102 is sandwiched in between rearward strap outer later 74 and rearward strap inner layer 76 along its entire length and held in this sandwiched arrangement by stitching 78. Although FIG. 9 only shows the second or lateral portion 90 of elastic material 86 being sandwiched between the two layers of lateral rearward strap 72, first or medial portion 88 of elastic material 86 is also sandwiched in between the two layers of medial rearward strap 72 in the identical manner. Thus, medial and lateral elastic portions 88 and 90 extend and slope downwardly from their rearward ends 102 which are substantially along a portion of the forward edge of rearward straps 72 to their forward ends 100 wherein their upper ends or edges 96 come in contact with the midsole at a location in the forefoot of the shoe. As seen in FIGS. 1 and 2, medial and lateral elastic portions 88 and 90 extend over approximately the middle half of the shoe. That is, approximately one-quarter of the length of the shoe is located forward of forward ends 100, and approximately one-quarter of the length of the shoe is located rearward of rearward end 102. The elastic portions 88 and 90 are disposed adjacent the instep and thereby adjacent to and overlie the medial and lateral longitudinal arches of the foot.

With reference to FIGS. 1, 6, and 8, lower ends 106 of each lateral strap 56 are attached to upper end or edge 96 of second or lateral portion 90 of elastic material 86. As shown in FIGS. 6 and 8, inner layer 60 of each lateral strap 56 is positioned on the inside of upper end 96 and the outer layer 58 of each lateral strap 56 is positioned on the outside of upper end 96. In this manner, the upper end 96 of lateral portion 90 of elastic material 86 is sandwiched in between the two layers of each lateral strap 56. Lateral portion 90 and each lateral strap 56 are held in this sandwiched relationship by stitching 62 on each of the straps. Any other suitable attaching means can also be used, for example an adhesive. As seen in FIG. 1, each lateral strap 56 overlaps second or lateral portion 90 to a different or varying degree. The amount the strap overlaps results in more or less elastic material being effectively engaged, and thus, provides for greater or lesser tension when the straps are drawn over the foot. Therefore, a greater or lessor amount of accommodation or stretch is made possible by varying the extent the strap overlaps the elastic material. With reference to FIG. 2, each medial strap 54 is attached to upper end 96 of first or medial portion 88 in the same manner as lateral straps 56 are attached to upper end 96 of second or lateral portion 90. Thus, each of the lateral and medial straps 54 and 56 are independently attached to medial and lateral portions 88 and 90 of elastic material 86. This individual attachment allows adjustment for customizing the tension and fit of the upper about the foot, and further, permits accommodation to the unique features of the wearer's foot.

With reference to FIGS. 6, 6A, 7 and 7A, the stitched together combination of medial and lateral elastic portions 88 and 90, vamp 26, and insole board 46 and the stitched together combination of rearward strap 72, inner sleeve 20, and insole board 46 both can be attached to the top of the midsole by any suitable means, for example glue or adhesive. With reference to FIGS. 6 and 6A, glue or adhesive can be applied to the bottom of elastic material 86 along its entire length and to insole board 46 and those structures then bonded to the top surface of midsole 14. Other suitable means, for example stitching, can be used to attach the medial and lateral portions 88 and 90 of elastic material 86 to sole 10. Further, medial and lateral portions 88 and 90 of elastic material 86 need not necessarily be in contact with the sole but can be attached to the upper of the shoe by any suitable means, for example stitching or adhesive, near or adjacent the top surface of the sole. By securing the medial and lateral portions 88 and 90 of elastic material 86 along the base of the upper or adjacent the top of the sole proximate the lasting margin 110, elastic material 86 is free to stretch about the foot in response to the tightening of medial and lateral straps 54 and 56.

With reference to FIG. 3, lace 108 is shown disposed in lace loops or eyelets 66 of medial and lateral straps 54 and 56 and in lace loops or eyelets 80 of rearward straps 72. As lace 108 is tightened, medial and lateral straps 54 and 56 individually and independently place under tension medial and lateral elastic portions 88 and 90, typically by stretching and elongating the elastic material forming portions 88 and 90, thus, drawing inner sleeve 20 and upper 16 about the foot. Although a lace is disclosed as being used for tightening the straps about the foot, it will be understood that any closure system running in between the straps or in between particular sets of straps can be used to tighten the straps about the foot, and thus, stretch the elastic material. The straps could be held in a tightened position by, for example VELCRO® or another securing mechanism.

The independent and separate attachment of straps 54 and 56 to elastic portions 88 and 90 allows the elastic portion to be independently made taut or stretched at discreet areas along the side of the foot thus offering a customized fit at discrete portions along the foot. The individual attachment of the straps allows the straps to "float" or move to a variety adjustable positions. Having the independent straps attached to continuous portions 88 and 90 of elastic material 86 provides for a continuity in between the discrete stretch points of the individually attached straps. Further, the continuous structure of elastic portions 88 and 90 adds to the strength of the elastic portions by allowing the elastic portions to be attached along their entire lower end. In addition, the continuous elastic portions stretch in the longitudinal direction when tightening the shoe (i.e., the elastic material is able to be stretched in four directions), thus, providing for greater adjustability and comfort. Thus, the present invention provides an elastic closure and fit system that can accommodate individual wearers given the elastic portions disposed on the medial and lateral sides of the foot.

Additionally, different sets of medial and lateral straps can be tightened more tightly than other sets. For instance, the forward most medial and lateral straps can be tightened more closely than the intermediate medial and lateral straps. This allows further individual adjustment of the shoe upper in relation to particular portions of the foot.

Figure 5:
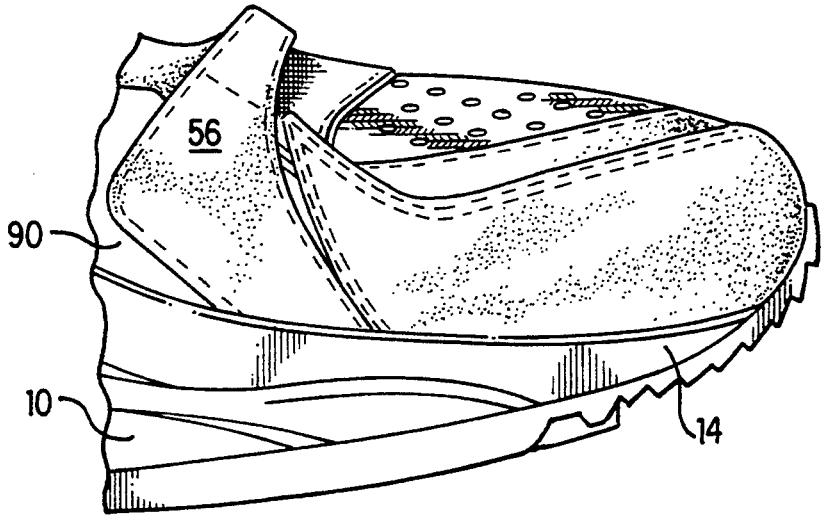
FIG. 5 shows a partial side elevational view of the lateral side of a right shoe having a closure and fit system according to a further embodiment of the present invention.

With reference to FIG. 5, an alternative embodiment is disclosed. In FIG. 5, the lower end of the forwardmost of lateral straps 56 is attached to the top of sole 10, and more particularly to the top of midsole 14. Thus, the forwardmost strap in this embodiment is not allowed to "float" or move independently with the elastic portion. Second or lateral elastic portion 90 is still disposed or sandwiched in between the forwardmost strap in this embodiment in the same manner as described in the other embodiment. However, elastic portion 90 does not have a forward end meeting the midsole. The forwardmost strap on the medial side, in this embodiment, is identical to the forwardmost lateral strap.

Figure 10:
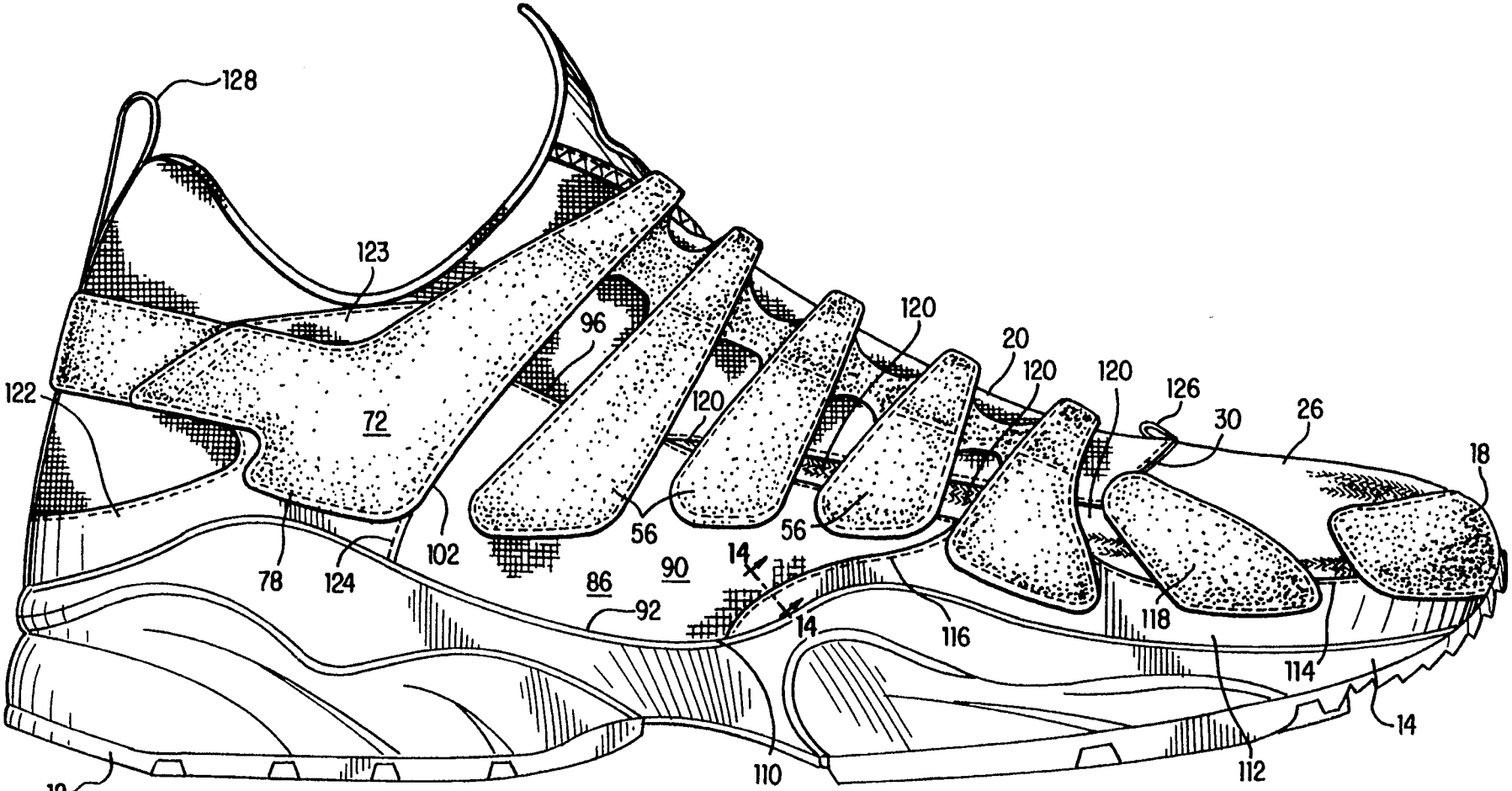
FIG. 10 shows a side elevational view of the lateral side of a right shoe having a closure and fit system according to a still further embodiment of the present invention.
Figure 11:
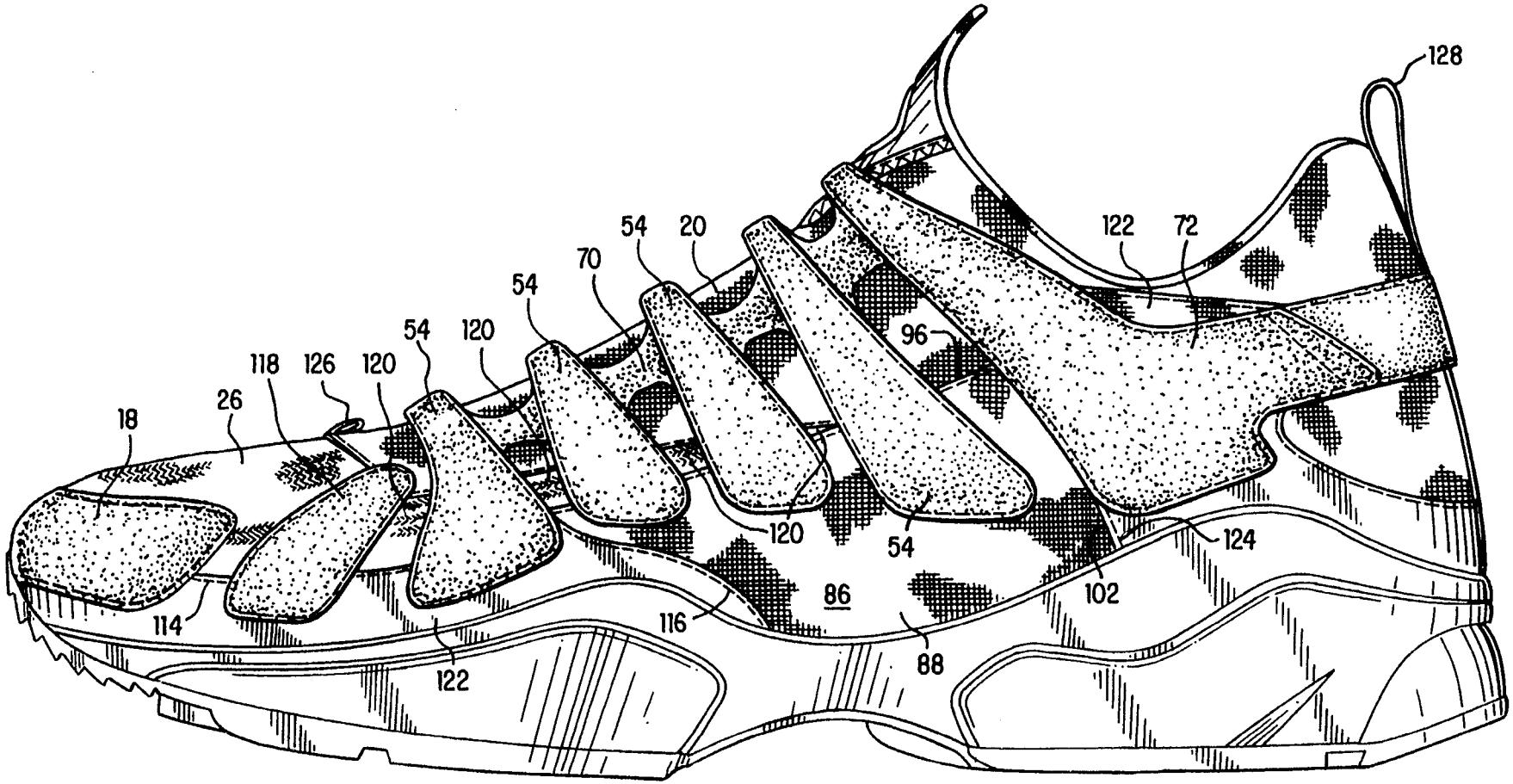
FIG. 11 shows a side elevational view of the medial side of the shoe depicted in FIG. 10.
Figure 14:
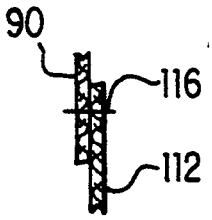
FIG. 14 shows a sectional view taken along line 14—14 of FIG. 10.

With reference to FIGS. 10–14, another alternative embodiment is shown. The same reference numerals used in the description of the previous embodiments are used in the description of this embodiment to designate identical or similar structures. With reference to FIGS. 10 and 11, vamp 26 is attached to a substantially non-stretchable portion 112 at stitch line 114. Tip section 18 is stitched onto vamp 26 and non-stretch portion 112. Non-stretch portion 112 extends rearward and is attached to a forward edge of elastic portion 90 along stitch line 116. Stitch line 116 extends from the upper end 96 of elastic portion 90 downward to the top of the sole. As shown in FIG. 14, the non-stretch material is positioned to the outside of lateral elastic portion 90 along stitch line 116. As shown in FIGS. 10 and 11, a triangular non-stretch section 118 is stitched to non-stretch portion 112, vamp 26, and inner sleeve 20. In this embodiment, the forwardmost of straps 56 is attached to the non-stretch portion 112 instead of to lateral elastic portion 90. Thus, this forwardmost strap is not allowed to "float" or move independently with the elastic portion. Also in this embodiment, vamp 26 does not extend rearward of triangular section 118, and thus, is not positioned behind the rearward sections of non-stretch portion 112 or behind lateral elastic portion 90. Because vamp 26 does not extend rearward, gaps 120 are formed along the side of the shoe for enhancing ventilation and are in spatial communication with the interior of the upper such that one can look into the interior of the upper when a foot is not disposed therein. The three rearwardmost of straps 56 are attached to lateral elastic portion 90 in the same manner as disclosed in earlier embodiments. A rearward non-stretchable portion 122 is disposed in between rearward strap 72 and inner sleeve 20 and is secured to rearward strap 72 by stitching 78. Rearward non-stretchable portion 122 is also stitched to inner sleeve 20 along stitch line 123. In this embodiment, rearward strap 72 does not extend all the way down to the sole. Instead, rearward non-stretchable portion 122 extends downward to the sole and is attached to insole board 46 and inner sleeve 20 in a stitching relationship similar to that shown in FIG. 7. In this embodiment, rearward non-stretchable portion 122 takes the place of rearward strap 72 in the stitching arrangement shown in FIG. 7. It is also possible for the stitching arrangement of FIG. 7A with non-stretchable portion 122 substituted for rearward strap 72 to be used in this embodiment. As in other embodiments, the two layers of rearward strap 72 can sandwich the rearward end 102 of lateral elastic portion 90. However, the lower portion of rearward end 102 of lateral elastic portion 90 is stitched to rearward non-stretch portion 122 along stitch line 124.

It is also possible for the rearward end 102 of lateral elastic portion 90 to be stitched to the inside surface of rearward non-stretch portion 122 such that it is positioned in between rearward non-stretch portion 122 and inner sleeve 20. In such an arrangement, rearward end 102 of lateral elastic portion 90 can be stitched along an extension of stitch line 124 extending upward to the upper end 96 of lateral elastic portion 90. It is also possible in this stitching arrangement for the stitching along the extension of stitch line 124 to go all the way through to the inner sleeve such that rearward non-stretch portion 122, rearward end 102 of the elastic portion 90, and inner sleeve 20 are all stitched together along such a stitch line.

Lateral elastic portion 90 is attached to insole board 46 in a manner similar to that shown in FIG. 6. However, in the stitching arrangement of this embodiment there is no vamp portion 26 in between lateral elastic portion 90 and insole board 46 such that stitching 48 connects the two together directly. As described earlier, vamp 26 does not extend behind lateral elastic portion 90. A stitching arrangement similar to that shown in FIG. 6A is also possible with this embodiment. In such a stitching arrangement vamp 26 is not present and insole board 46 and lateral elastic portion 90 are held in a flush relationship by stitching 52. Non-stretch portions 112 and 122 can be made of any suitable substantially non-stretchable material such as for instance natural or synthetic leather.

Figure 12:
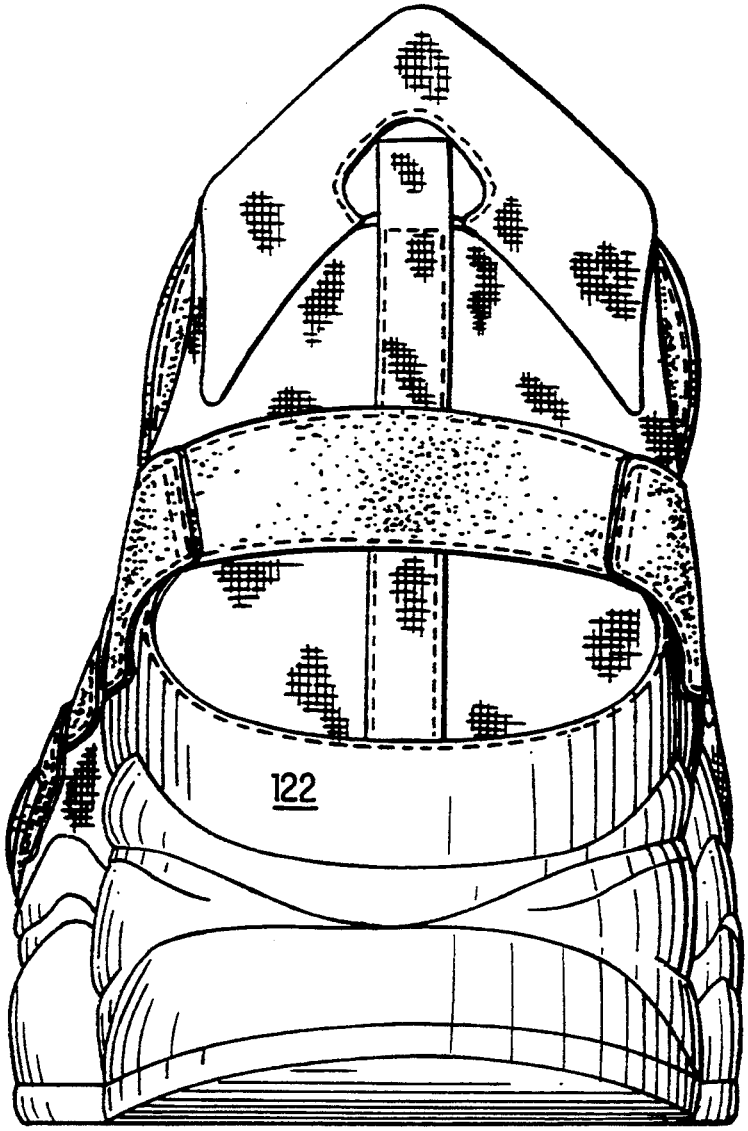
FIG. 12 shows a rear elevational view of the shoe depicted in FIG. 10.
Figure 13:
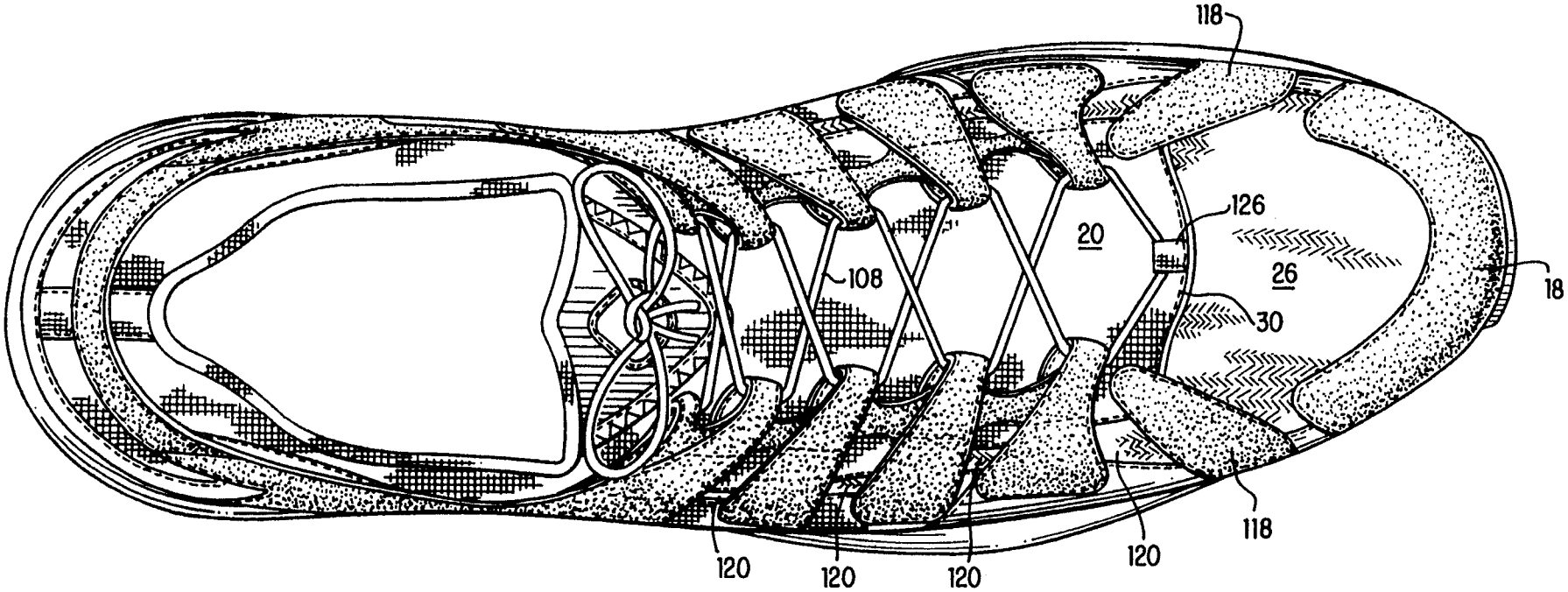
FIG. 13 shows a top plan view of the shoe depicted in FIG. 10.

With reference to FIG. 13, a lace loop 126 is also positioned at the top of the shoe along stitch line 30. Lace 108 passes through lace loop 126 in the lacing arrangement. Additionally, a pull loop 128 for facilitating entry and exit of the foot is disposed on the back of the heel of the shoe. With reference to FIG. 12 rearward non-stretch portion 122 extends around the back of the heel and is continuous with an identical rearward non-stretch portion disposed on the medial side of the shoe. The structures on the medial side of the shoe are identical to those on the lateral side, and thus, explanation of the structures on the medial side is omitted.

It will be understood that variations and changes in the details, materials, and arrangement of the parts, which have been herein described and illustrated in order to explain the nature of the invention, may be made by those skilled in the art within the principles and scope of the invention. What is sought to be protected herein is as recited in the appended claims.

We claim:

1. A shoe having a closure system for securing and fitting the shoe to a foot, comprising:

an upper for surrounding the foot, the upper including an inner portion:

a sole;

elastic material having an upper edge and a lower edge, said lower edge being secured along the base of the upper on the medial and lateral sides and the upper edge being separate and disconnected from the upper;

a plurality of straps separately attached adjacent a lower end thereof to said elastic material, said straps made of a substantially inelastic material;

closure means, disposed at the upper ends of said straps, for drawing the straps about the foot to place said elastic material disposed along said medial and lateral sides under tension independently of the tension in the inner portion of the upper; and a rearward strap in addition to said plurality of straps, said rearward strap disposed rearward of said plurality of straps and having an upper end and a lower end, said rearward strap lower end secured along the base of the upper and said elastic material attached to said rearward strap at a point in between said upper and lower ends.

2. The shoe of claim 1 wherein said elastic material is attached to said upper along the base of the upper.

3. The shoe of claim 1 wherein said elastic material is attached to the top surface of said sole along the base of the upper.

4. The shoe of claim 1 wherein said lower ends of said straps are secured to said upper edge of said elastic material.

5. The shoe of claim 1 wherein said closure means includes lace holes disposed on said upper ends of said straps for receiving a lace.

6. The shoe of claim 1 wherein said elastic material has a first continuous portion disposed on the medial side of the shoe and a second continuous portion disposed on the lateral side of the shoe, and wherein said plurality of straps have a first plurality of straps which are attached to said first continuous portion and a second plurality of straps which are attached to said second continuous portion.

7. The shoe of claim 6 wherein said first and second continuous portions of elastic material are located adjacent the medial and lateral longitudinal arches of the foot, respectively.

8. The shoe of claim 7 wherein said first and second continuous portions of elastic material are located in the central longitudinal area of the shoe.

9. The shoe of claim 8 wherein said first and second continuous portions each have a forward and a rearward end and a length extending approximately one-half the length of the shoe.

10. The shoe of claim 1 wherein said elastic material is secured along the lasting margin of the shoe.

11. A shoe comprising:

a sole;

an upper attached to the top of said sole;

a first portion of elastic material disposed along one side of the shoe and having a lower end and an upper end, said first portion lower end secured adjacent the top of said sole and said first portion upper end remaining separate and free from said upper;

a first plurality of straps each having a lower end and an upper end, each said strap lower end separately attached to said first portion upper end, each said strap made of a substantially inelastic material;

closure means, disposed on said upper ends of said straps, for drawing the straps upwards to place under tension said first portion of elastic material; and a rearward strap in addition to said first plurality of straps, said rearward strap disposed rearward of said first plurality of straps and having an upper end and a lower end, said rearward strap lower end secured adjacent the top of said sole and said first portion of elastic material attached to said rearward strap at a point in between said upper and lower ends.

12. The shoe of claim 11 further comprising:

a second portion of elastic material disposed on the other side of the shoe and having a lower end and an upper end, said second portion lower end secured adjacent the top of said sole and said second portion upper end remaining separate and free from said upper;

a second plurality of straps each having a lower end and an upper end, each said second strap lower end separately attached to said second portion upper end, each said second strap made of a substantially inelastic material; and wherein said closure means is disposed on both said first and second plurality of straps for drawing said straps about the foot and placing under tension said first and second portions of elastic material.

13. The shoe of claim 12 wherein said first and second portions of elastic material both are continuous pieces of material and are located adjacent the instep.

14. The shoe of claim 12 wherein said first and second portions of elastic material both are continuous pieces of material and are located in the central longitudinal area of the shoe.

15. The shoe of claim 14 wherein said first and second continuous portions each have a forward end and a rearward end and a length extending approximately one-half the length of the shoe.

16. The shoe of claim 13 wherein said upper includes a layer of material underlying said first and second portions of elastic material and said first and second pluralities of straps, said upper ends of said first and second portions of elastic material being separate from and unattached to said underlying layer of material.

17. The shoe of claim 16 wherein said underlying material extends down to, and is secured to, said sole.

18. The shoe of claim 12 wherein said first and second portions of elastic material are secured along the lasting margin of the shoe.

19. The shoe of claim 12 wherein the elastic material is attached to the upper adjacent the top of said sole.

20. The shoe of claim 12 wherein the elastic material is attached to the top surface of said sole.

21. The shoe of claim 12 wherein said closure means includes lace holes disposed on said upper ends of said straps for receiving a lace.

22. The shoe of claim 12 wherein said first portion of elastic material is a continuous piece of material.

23. The shoe of claim 12 wherein said upper includes a layer of material underlying said first portion of elastic material and said first plurality of straps, said upper end of said first portion of elastic material being separate from and unattached to said underlying layer of material.

24. The shoe of claim 23 wherein said underlying material extends down to, and is secured to, said sole.

25. A shoe having a closure system for securing the shoe to a foot, comprising:

an upper;

a sole;

a medial portion of elastic material disposed on the medial side of the shoe and secured along the base of the upper;

a lateral portion of elastic material disposed on the lateral side of the shoe and secured along the base of the upper;

a first plurality of straps each having a lower end and an upper end, said lower end secured to said medial portion of elastic material, said first plurality of straps made of a substantially inelastic material;

a second plurality of straps each having a lower end and an upper end, said lower end secured to said lateral portion of elastic material, said second plurality of straps made of a substantially inelastic material;

a rearward strap in addition to said first and second plurality of straps, said rearward strap disposed rearward of said first and second plurality of straps and having an upper end and a lower end, said rearward strap lower end secured along the base of the upper and one of said medial and lateral portions of elastic material attached to said rearward strap at a point in between said upper and lower ends, and closure means, attached to the upper ends of said first and second plurality of straps, for tightening the straps around the foot.

26. The shoe of claim 25 wherein the medial and lateral portions of elastic material are attached to the upper along the base of the upper.

27. The shoe of claim 25 wherein the medial and lateral portions of elastic material are attached to the top surface of the shoe sole along the base of the upper.

28. The shoe of claim 25 wherein said medial and lateral portions of elastic material have an upper end and said lower ends of said first and second plurality of straps are secured to said upper ends.

29. The shoe of claim 25 wherein said closure means includes lace holes disposed at said upper ends of said straps for receiving a lace.

30. The shoe of claim 25 wherein said medial and lateral portions of elastic material are both continuous pieces of material.

31. The shoe of claim 26 wherein said medial and lateral portions of elastic material have an upper edge slanting downward from the rear of the shoe towards the front of the shoe.

32. The shoe of claim 25 wherein said medial and lateral portions of elastic material are secured along the lasting margin of the shoe.

* * * * *